United States Patent [19]

Wettstein

[11] Patent Number: 5,004,239

[45] Date of Patent: Apr. 2, 1991

[54] GOLF CLUB AND GOLF BALL CLEANING DEVICE

[76] Inventor: Rick L. Wettstein, 10909 W. 65th Way, Arvada, Colo. 80004

[21] Appl. No.: 479,937

[22] Filed: Feb. 14, 1990

[51] Int. Cl.[5] ..... A46B 15/00; A63B 53/00; A63B 57/00

[52] U.S. Cl. ..... 273/162 F; 15/21.2; 15/160; 15/104.94; 15/246; 273/32 B

[58] Field of Search ..... 273/162 R, 162 F, 32 B, 273/32 R; 15/21 A, 160, 184, 210 R, 104.94, 246

[56] References Cited

U.S. PATENT DOCUMENTS

| | | | |
|---|---|---|---|
| 1,669,836 | 5/1928 | Neuberth | 273/162 F |
| 1,714,346 | 5/1929 | Carleton | 273/162 F |
| 2,639,804 | 5/1953 | Merahn | 273/162 F |
| 2,739,331 | 3/1956 | Goodman | 15/160 |
| 3,006,009 | 10/1961 | Hoffecker | 15/21 A |
| 3,531,814 | 10/1970 | Safalow | 15/160 |
| 4,553,752 | 11/1985 | Bagg | 15/184 |

*Primary Examiner*—George J. Marlo
*Attorney, Agent, or Firm*—Gary M. Polumbus

[57] ABSTRACT

A ball cleaning device includes a base and a pivoted cap each of which has a concave cleaning surface therein so that when placed in a preselected angle relative to each other provide a large cleaning surface area for cleaning a golf ball. The device can be incorporated into or onto the grip of a golf club.

11 Claims, 2 Drawing Sheets

GOLF CLUB AND GOLF BALL CLEANING DEVICE

BACKGROUND OF THE INVENTION

1. Field of the Invention

The present invention relates generally to golf equipment and more particularly to a device for cleaning golf balls which can be incorporated into or onto a golf club.

2. Description of the Prior Art

As is well known to anyone who plays golf, the golf ball will frequently become dirty and in order to maintain desired flight properties and to make the ball suitable for putting, it is frequently necessary to clean the golf ball. Mechanical golf ball washers are found on most golf courses adjacent the teeing grounds but such locations are normally not convenient when putting. In other words, when on the putting green, it is standard procedure to mark one's ball and clean it prior to putting. Since the ball washers are not adjacent to the greens, other systems need to be employed in order to clean the ball. Many golfers carry wet towels on their golf bag or merely rub the ball against the grass on the green or surrounding area as a means of cleaning the ball. Neither system is always desirable, however, since all golfers don't carry towels and the grass on the green or surrounding areas is not always wet enough to effect an adequate cleaning of the ball.

The prior art includes numerous devices for cleaning golf balls. By way of example, U.S. Pat. No. 1,710,816 issued to Evans on Apr. 30, 1929, U.S. Pat. No. 3,462,230 issued to Beard on Aug. 19, 1969 and U.S. Pat. No. 4,411,040 issued to Sharrow et al. on Oct. 25, 1983, disclose devices for washing golf balls wherein a generally cup shaped surface is provided that includes a material suitable for abrasively cleaning the surface of the golf ball.

U.S. Pat. No. 3,006,009 issued to Hoffecker on Oct. 31, 1961, U.S. Pat. No. 3,041,645 issued to Smith on July 13, 1962, U.S. Pat. No. 3,583,016 issued to MoConnell on June 8, 1971, U.S. Pat. No. 4,381,574 issued to Bendovsky on May 3, 1983, and U.S. Pat. No. 4,442,564 issued to Berry on Apr. 17, 1984 all disclose various other ball washing implements which are suitable for use in cleaning golf balls.

It is also known in the art to incorporate certain golf implements into the end of a golf club. Examples of such arrangements are found in U.S. Pat. No. 4,799,684 issued to Rango on Jan. 24, 1989 and U.S. Pat. No. 4,239,216 issued to Bauer on Dec. 16, 1980 with golf clubs disclosed therein including tools for repairing a golf course green after a golf ball has torn a divot therefrom. Another example of an implement incorporated into a golf club is disclosed in U.S. Pat. No. 4,553,752 issued to Bagg on Nov. 19, 1985 wherein a golf club handle includes a powder carrying chamber and means by which charges of powder can be selectively dropped on a green to mark the position of a golf ball. The golf club disclosed in the Bagg patent also includes a brush on the end of the club which can be scraped across the green to disburse the powder after a golf ball has been replaced so as not to mislead golfers on the same green later in the day.

It will therefore be seen from the state of the art that while devices have been devised for cleaning golf balls and golf clubs have been modified to incorporate various implements useful in the game of golf, the prior art is devoid of a system for incorporated a ball cleaning device into a golf club and also a system that improves upon the state of ball cleaning devices.

It is to overcome the shortcomings in prior art ball cleaning devices that the present invention has been developed.

SUMMARY OF THE INVENTION

The golf ball cleaning device of the present invention includes a base and a pivotally connected cap with both the base and the cap having a concave surface therein adapted for cleaning the surface of the golf ball. The concave surfaces may be made of sponge or a similar water absorbent material having a somewhat abrasive surface so that the engagement of the ball against the surface will readily clean the surface of the ball.

Stop means are provided to limit pivotal movement of the cap relative to the base to substantially 90 degrees so that the concave surface in both the base and the cap will complement each other when the cap is in an open position to establish contact with the ball over substantially a 180 degree arc.

The device of the present invention can be incorporated into the grip of the golf club or into an accessory which can be removably mounted on the grip of the golf club thereby being transferable between clubs.

Other aspects, features and details of the present invention can be more completely understood by reference to the following detailed description of preferred embodiments taken in conjunction with the drawings, and from the appended claims.

DESCRIPTION OF THE PREFERRED EMBODIMENTS

Figure 1:
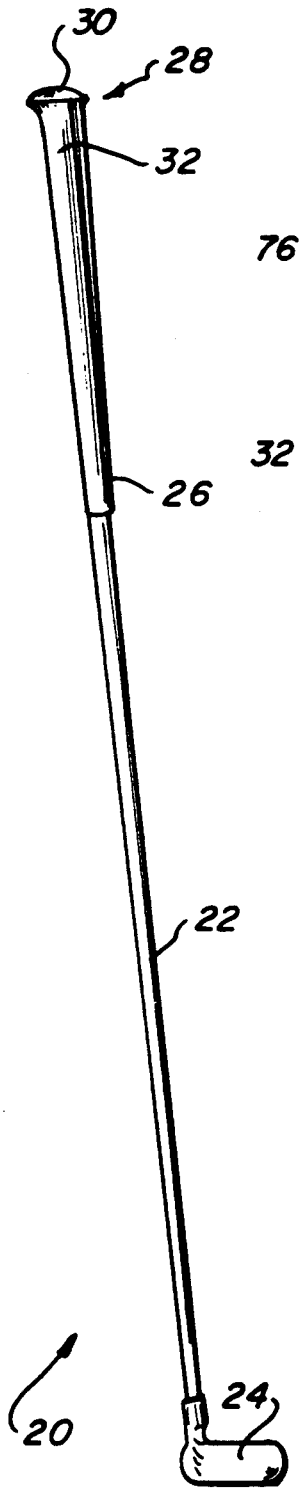
FIG. 1 is a perspective view of a golf club incorporating the ball cleaning device of the present invention.

Referring first to FIG. 1, a golf club 20 in the form of a putter is shown and has an elongated shaft 22 with a putter head 24 mounted on one end thereof and an elongated grip 26 mounted on the opposite end. The grip is similar to a grip found on most conventional golf putters except that a ball cleaning device 28 in accordance with a first embodiment of the present invention has been incorporated into the terminal or closed end 30 of the grip.

Figure 2:
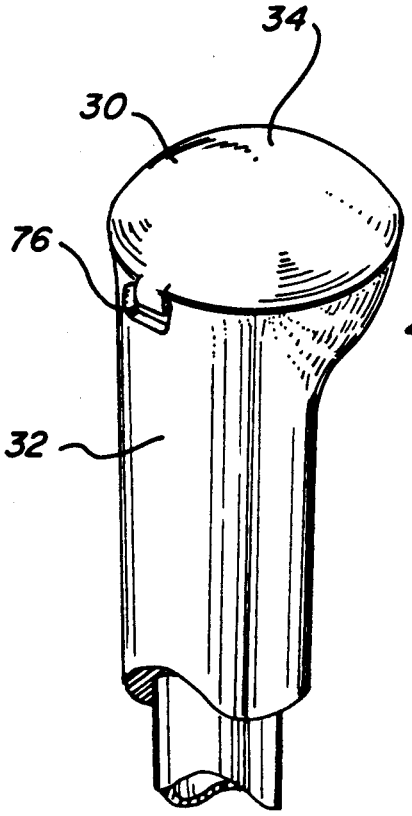
FIG. 2 is an enlarged fragmentary perspective view of the grip end of the golf club illustrated in FIG. 1 with the cap in a closed position.
Figure 3:
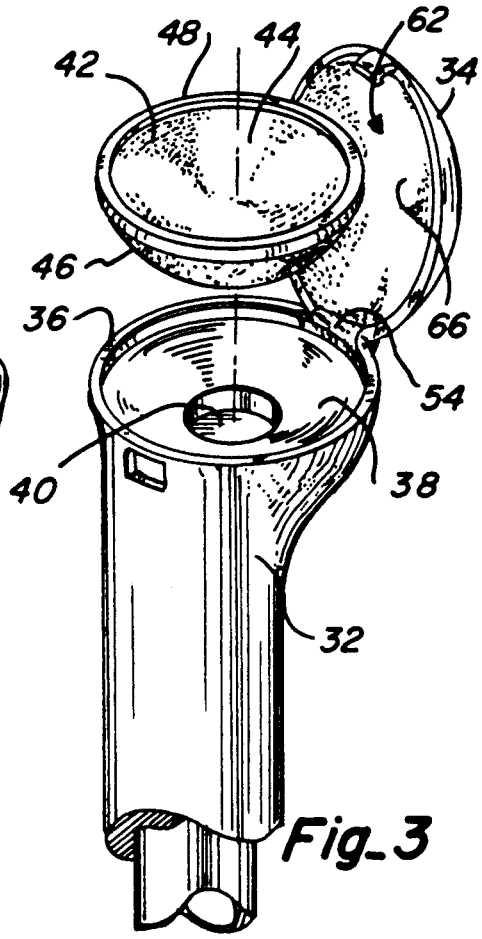
FIG. 3 is an enlarged, fragmentary, partially exploded view similar to FIG. 2 with the cap in an open position.
Figure 4:
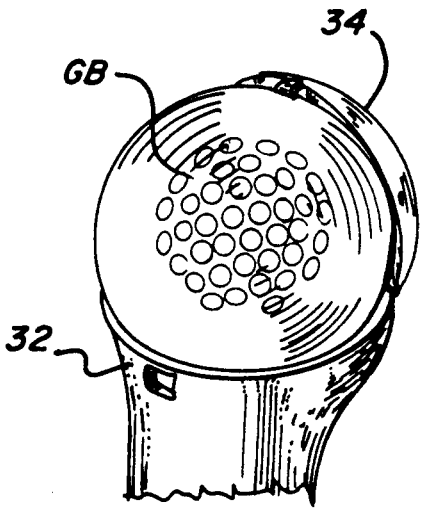
FIG. 4 is an enlarged fragmentary view similar to FIG. 3 with a golf ball positioned in the device for cleaning purposes.
Figure 9:
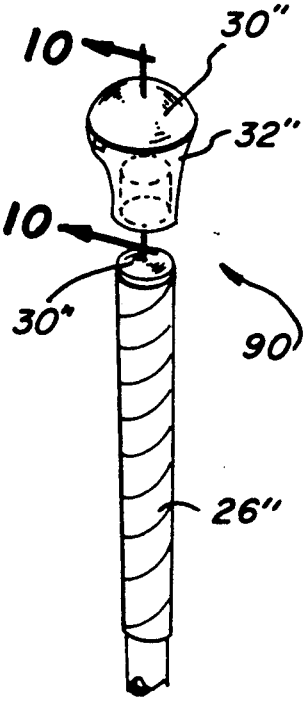
FIG. 9 is a perspective view of an alternative arrangement of the device of the present invention shown with the grip end of a golf club as a removable attachment to the golf club.
Figure 10:
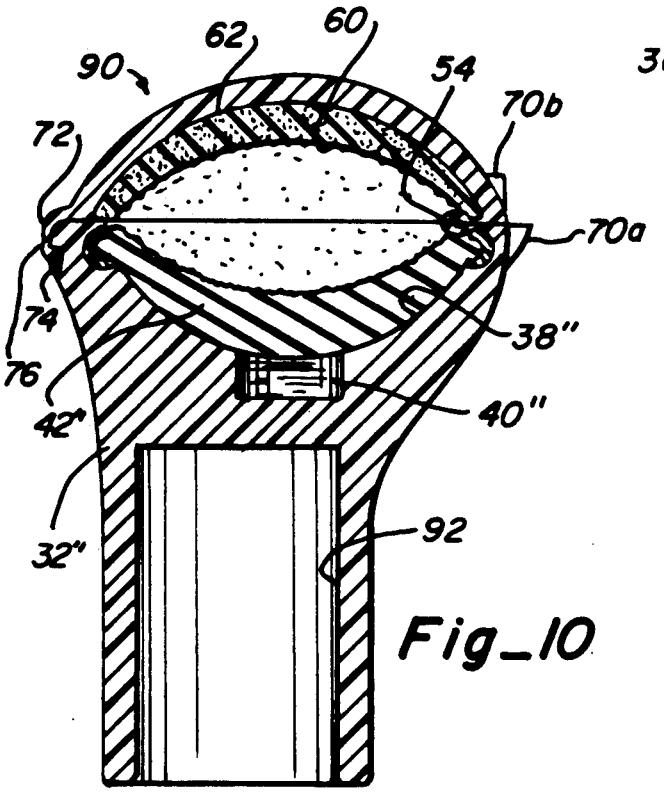
FIG. 10 is an enlarged section taken along line 10—10 of FIG. 9.
Figure 5:
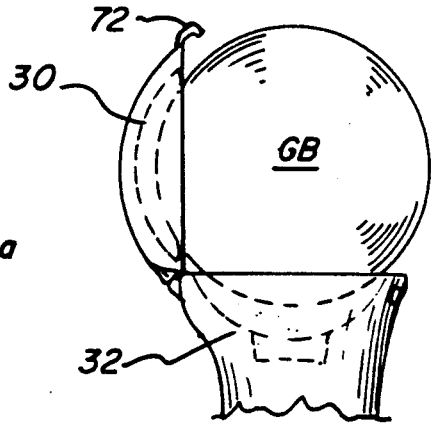
FIG. 5 is an enlarged fragmentary side elevational view showing the end of the golf club illustrated in FIG. 1 with the cap in an open position and a ball positioned in the device for cleaning purposes.
Figure 6:
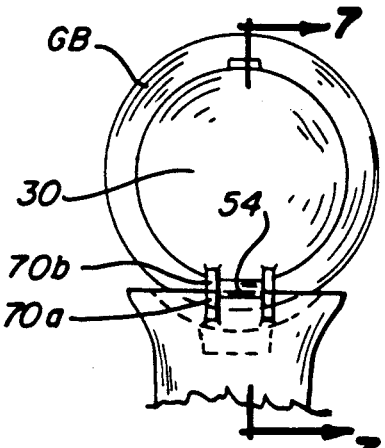
FIG. 6 is an enlarged fragmentary rear elevation similar to FIG. 5.

As best seen in FIG. 2–7, the first embodiment 28 of the golf ball cleaning device of the present invention can be seen to include a base 32 which is merely the grip 26 of the golf club itself and a cap 34 which is pivotally connected to the base for movement between an open position as illustrated in FIG. 3 and a closed position as illustrated in FIG. 2.

The exposed end 36 of the base is flat and has a concave substantially hemispherical recess 38 provided therein. A circular bore 40 extends axially of the golf club a short distance beyond the hemispherical surface of the recess for a reason to be explained later. Releasably seated within the hemispherical recess is a water absorbent ball cleaning pad 42 defining a concave cleaning surface 44 adapted for engagement with a golf ball GB. The ball cleaning pad 42 could be any suitable material which is water absorbent and has some sort of a mildly abrasive texture so as to readily clean the surface of a golf ball. An example of a material which has been found to be ideally suited is used in a cleaning pad sold under the trademark "Scotch-Brite"® by 3M-Consumer Specialties Division of St. Paul, Minnesota. The cleaning pad 42 is removable from the hemispherical recess 38 so that water can be placed in the circular bore 40 to thereby feed moisture to the cleaning pad.

The cleaning pad 42 is formed to have a convex surface 46 on one side adapted to mate with the concave recess 38 in the base 32 and the concave cleaning surface 44 on the opposite side. The pad has a circular, preferably hard rubber, ring 48 bonded to a rib 50 formed in the peripheral edge of the absorbent material in the pad with the ring 48 being adapted to mate with and be releasably received in an annular recess 52 formed in the perimeter of the concave recess 38. In this manner the absorbent pad can be easily removed from the base for replacement or to permit water to be poured into the circular bore 40.

The cap 34 is configured to simulate an arcuate portion of a sphere and is pivotally connected to the base 32 by a living hinge 54. Accordingly, the cap would normally be made of a material identical to that of the grip 26 which might be a moderately hard rubber. The cap has a convex outer surface 56 which forms the terminal end of the grip when in a closed position, FIG. 2, and has a concave inner surface 58. A cleaning pad 60 is permanently disposed in the recess 62 defined by the concave inner surface 58 of the cap. The pad 60 could be made of any suitable absorbent or mildly abrasive material but the "Scotch Brite"® material referenced before has been found desirable. The cleaning pad 60 in the cap also has a concave cleaning surface 66 so as to engage an arcuate portion of the surface of the golf ball GB.

A pair of abutment stops **70*a* and 70*b* are provided on the base 32 and on the cap 34 respectively adjacent the living hinge 54** so that when the cap is pivoted into its open position wherein it forms substantially a 90 degree angle with the base, the abutment stops engage each other to prevent further pivotal movement. As will be appreciated by reference to FIGS. 5 and 7, when the cap is in the fully open position, the concave cleaning surfaces in both the base and the cap form a substantially continuous cleaning surface extending approximately 180 degrees around a golf ball positioned therein.

Figure 7:
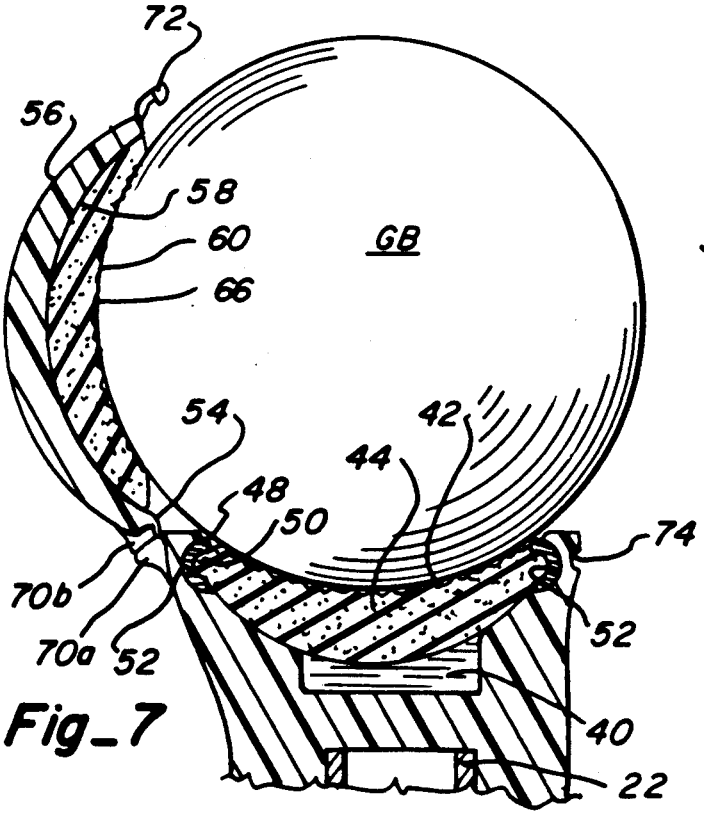
FIG. 7 is an enlarged section taken along line 7—7 of FIG. 6.

A free edge of the cap 34 has a hook-shaped latch finger 72 formed thereon which is adapted to grasp a lip 74 on the base. The lip is defined by a notch 76 formed in the base. The notch is best illustrated in FIGS. 2, 3 and 7. The latch finger is shown secured in the notch to releasably retain the cap in its closed position in FIG. 2.

Figure 8:
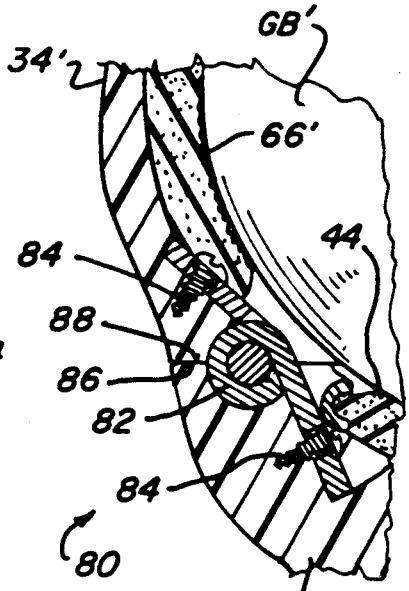
FIG. 8 is a fragmentary section illustrating an alternative arrangement for pivotally connecting the cap to the base of the device.

An alternative embodiment 80 of the present invention is illustrated in FIG. 8 with like parts having been given like reference numerals with a prime suffix. In this embodiment, the living hinge 54 and abutment stops **70*a* and 70*b* are replaced with a mechanical hinge 82 that is affixed to the base 32' and the cap 34' with conventional screw type fasteners 84. The hinge is designed to permit only a 90 degree pivotal movement between the cap and the base so when the cap has been moved 90 degrees into its open position, the hinge prevents further pivotal movement. To assist in this regard, the cap has a flat abutment face 86 adapted to engage the end surface 88 of the base which also assists in preventing pivotal movement in excess of 90 degrees. In this embodiment, as with the first described embodiment, when the cap and base form a 90 degree angle relative to each other, the cleaning surfaces 44' and 66'** provided in the base and the cap respectively are complementary to simultaneously clean a large surface area of the golf ball GB'.

In a third embodiment 90 of the present invention, the base and cap are formed similarly to that described in the first disclosed embodiment with like parts having been given like reference numerals with a double prime suffix. The base 32'' is in the form of a relatively large sleeve having a recess 92 in a lower end adapted to receive the terminal end 30'' of a golf club grip 26''. In this manner, the base can be removably positioned on the end of the golf club grip. The base 32'' has a flat upper end in which a concave generally hemispherical recess 38'' has been formed and a cylindrical bore 40'' protruding beyond the hemispherical recess. A water absorbent somewhat abrasive pad 42'' is positioned in the hemispherical recess in a position to absorb water that is placed in the bore 40''.

A cap 34'' is connected to the base 32'' by a living hinge 54'' with the cap and the base having abutment stops **70*a*'' and 70*b*'' to prevent excessive pivotal movement as described hereinbefore in regard to the first described embodiment. A cleaning pad 60'' is positioned in a concave recess 62'' provided in the cap in a position to assist in cleaning a golf ball. A latch finger 72'' is also provided on the cap and is adapted to cooperate with a lip 74'' on the base which is formed by a notch 76''** formed in the base adjacent to the flat upper end.

It will be appreciated that the golf ball cleaning device of the present invention provides a large cleaning surface area and is readily adaptable to incorporation into or onto the terminal end of a golf club grip so that it is readily available at any time. The device is particularly useful when mounted on a putter as a golfer will typically clean his ball on the putting green and the ball cleaner of the present invention, of course, would be readily available.

I claim:

1. A device for cleaning golf balls comprising in combination, a base having a first concave surface thereon, said first concave surface having cleaning means for cleaning a golf ball, a cap pivotally connected to said base having a second concave surface, said cap being pivotal between a closed position in faced relationship with said base and an open position forming an angle relative to said base, said second concave surface having means for cleaning a golf ball, and stop means operatively associated with said base and cap to limit the extent to which said pivotal movement of the cap may be pivotally moved relative to said base whereby the concave surfaces on the base and the cap will simultaneously engage a golf ball and be complementary in the cleaning of a golf ball when said cap is in said open position.

2. The device of claim 1 wherein said stop means are integral with said base and cap and are adapted to cause said cap and base to abut one another when the cap is moved to its open position.

3. The device of claim 2 further including hinge means for pivotally connecting the cap to the base.

4. The device of claim 1 wherein said stop means is a hinge operatively interconnecting the base and the cap, said hinge having a maximum range of pivotal movement which places the concave surfaces on the base and the cap in complementary positions for cleaning a golf ball.

5. The device of claim 1 further including latch means on said base and cap for selectively securing the cap in its closed position relative to the base.

6. The device of claim 1 further including a golf club having a shaft with a head at one end and a grip at the opposite end and wherein said device is incorporated into the grip of the golf club with the grip defining said base of the device.

7. The device of claim 6 wherein said grip defines a sleeve adapted to be fitted over said opposite end of the shaft and wherein one end of the sleeve is closed by said device.

8. The device of claim 1 further including a golf club having a shaft with a head at one end and a grip at the opposite end and wherein said device is removably connected to said grip at said opposite end of the shaft.

9. A device for cleaning golf balls comprising in combination a golf club having a shaft with a head at one end, a grip at the opposite end, and further including a concave recess formed in said opposite end, said recess containing means for absorbing moisture thereby forming a golf ball cleaning surface incorporated into said grip.

10. The device of claim 9 wherein said golf ball cleaning surface includes means for temporarily remaining moist.

11. The device of claim 10 wherein said cleaning surface is absorptive of water.

* * * * *